US010648768B1

(12) United States Patent
Oglesby

(10) Patent No.: US 10,648,768 B1
(45) Date of Patent: May 12, 2020

(54) ANTI-ROTATION END PLATE AND CASTLE NUT

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 125 days.

(21) Appl. No.: 15/927,372

(22) Filed: Mar. 21, 2018

Related U.S. Application Data

(60) Provisional application No. 62/474,901, filed on Mar. 22, 2017.

(51) Int. Cl.

| | |
|---|---|
| ***F41A 3/84*** | (2006.01) |
| ***F41C 23/14*** | (2006.01) |
| ***F41C 27/00*** | (2006.01) |
| ***F41C 23/16*** | (2006.01) |
| *F41C 23/02* | (2006.01) |

(52) U.S. Cl.
CPC ..... *F41C 23/14* (2013.01); *F41C 23/16* (2013.01); *F41C 27/00* (2013.01); *F41C 23/02* (2013.01)

(58) Field of Classification Search
CPC .... F41A 3/84; F41A 11/00; F41A 3/78; F41C 23/00
See application file for complete search history.

(56) References Cited

U.S. PATENT DOCUMENTS

| | | | | |
|---|---|---|---|---|
| 8,468,729 | B1 * | 6/2013 | Sylvester | F41A 3/84 42/1.01 |
| 9,488,435 | B1 * | 11/2016 | Roberts | F41C 23/14 |
| 9,523,552 | B2 * | 12/2016 | Eitan | F41C 23/02 |
| 9,927,192 | B1 * | 3/2018 | Sylvester | F41A 3/78 |

* cited by examiner

*Primary Examiner* — J. Woodrow Eldred
(74) *Attorney, Agent, or Firm* — Shaddock Law Group, PC

(57) ABSTRACT

An end plate and castle nut, including at least some of an end plate having at least one pawl, wherein said at least one pawl extends from a biased, tension arm formed in the end plate; and a castle nut having one or more grooves formed in a front face of the castle nut, wherein each of the one or more grooves is formed so as to accept at least a portion of the at least one pawl at least partially therein.

20 Claims, 13 Drawing Sheets

ANTI-ROTATION END PLATE AND CASTLE NUT

CROSS-REFERENCE TO RELATED APPLICATIONS

This patent application claims the benefit of U.S. Patent Application Ser. No. 62/474,901, filed Mar. 22, 2017, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an end plate and castle nut for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a fixed or variable position buttstock. Typically, the variable position buttstock is slidable and lockable at various positions along a buffer tube.

The typical buffer tube includes a capped cylindrical portion having a threaded portion for installation into a buffer tube receiving aperture of a lower receiver. Typically, an end plate and a castle nut are utilized to complete installation of the buffer tube on the receiver.

The castle nut is typically a circular and notched nut that screws onto the buffer tube and keeps the buffer tube and end plate secured in place, relative to the lower receiver. On a standard, mil-spec, castle nut, substantially square notches or castle nut engagement recesses are formed on one side (the rear face) of the castle nut, which allow a wrench or other tool to be used to torque the castle nut against the end plate. Smaller notches or indents are formed on the other side (the front face), which allow the castle nut to be staked, once appropriately torqued against the end plate.

If the castle nut is not properly staked, the castle nut can become loose, which will allow the end plate to move away from the lower receiver, potentially allowing the takedown pin spring and detent to fall out of the rear takedown detent/spring aperture. If the castle nut loosens, the buffer tube can also retract from the lower receiver, and no longer hold the buffer retainer in place.

If the buffer retainer is not held in place, the buffer and buffer spring may also be displaced, which will affect the ability of the firearm to fire and/or cycle.

In order to stake the castle nut, the castle nut is first properly installed at 40 foot pounds of torque on the buffer tube. A spring loaded or standard center punch and hammer are then used to manipulate enough material from the end plate into one or more of the small notches on the castle nut. This will then render the castle nut properly staked, such that it will not rotate relative to the end plate.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Unfortunately, castle nuts are not always properly staked, which can still allow the castle nut to be loosened.

The disadvantages and shortcomings of the prior art are overcome by the features and elements of the anti-rotation end plate and castle nut of the present disclosure. The advantages of the present disclosure are attained by providing, in certain exemplary, nonlimiting embodiments, an end plate and castle nut that includes at least one pawl, which extends from a biased, resilient or tension arm formed in the end plate. The castle nut includes one or more radial teeth or grooves formed in a front face of the castle nut. Thus, while being installed, as the castle nut is tightened on the buffer tube, the pawl engages the grooves and urge the biased, tension arm to a further biased position and increase the frictional engagement force between the pawl and a subsequent groove.

When the castle nut is appropriately torqued, at least a portion of the pawl will rest within at least one of the grooves. The interaction between the pawl of the end plate and the groove of the castle nut, acts to catch the castle nut and stop the castle nut from being able to counter-rotate or loosen through normal use.

Using the end plate and castle nut of the present disclosure, the castle nut does not need to be staked. In addition, it is possible to hand tighten the castle nut and the castle nut still function reliably as the castle nut cannot come loose. Using the end plate and castle nut of the present disclosure, a user is able to remove the castle nut with the use of a armorers tool.

In various exemplary embodiments, the tension arm is formed of an area of the end plate, having a reduced wall thickness, which causes the tension arm to act like a flat spring.

In certain exemplary, nonlimiting embodiments of the present disclosure, the anti-rotation end plate and castle nut include at least some of an end plate having at least one pawl, wherein said at least one pawl extends from a biased, tension arm formed in said end plate; and a castle nut having one or more grooves formed in a front face of said castle nut, wherein each of said one or more grooves is formed so as to accept at least a portion of said at least one pawl at least partially therein.

In certain exemplary, nonlimiting embodiments, said tension arm is formed of an area of said end plate, having a reduced wall thickness.

In certain exemplary, nonlimiting embodiments, said tension arm is formed as an integral portion of said material used to form said end plate and is defined by a slot or groove formed in at least a portion of said end plate.

In certain exemplary, nonlimiting embodiments, said tension arm is attached or coupled to said end plate.

In certain exemplary, nonlimiting embodiments, a buffer tube key extends into at least a portion of said buffer tube aperture.

In certain exemplary, nonlimiting embodiments, a hole, aperture, recess, or protrusion is forms an endplate attachment element in or through at least a portion of said end plate.

In certain exemplary, nonlimiting embodiments, one or more texturing elements are formed around at least a portion of said end plate.

In certain exemplary, nonlimiting embodiments, said at least one pawl comprises two side walls, which extend to an apex.

In certain exemplary, nonlimiting embodiments, when said tension arm is in a normal or non-flexed position, at least a portion of said at least one pawl extends above a rear face of said end plate.

In certain exemplary, nonlimiting embodiments, said castle nut includes an at least partially internally threaded castle nut aperture, wherein said at least partially internally threaded castle nut aperture is formed so as to interact with external threads of a buffer tube.

In certain exemplary, nonlimiting embodiments, one or more texturing elements are formed around at least a portion of said castle nut.

In certain exemplary, nonlimiting embodiments, each of said one or more grooves extend radially and said front face of said castle nut.

In certain exemplary, nonlimiting embodiments, each of said one or more grooves comprises a substantially rectangular, "U", or "V" shaped recess or groove.

In certain exemplary, nonlimiting embodiments of the present disclosure, the anti-rotation end plate and castle nut include at least some of an end plate extending from a front face to a rear face and having at least one pawl extend above a surface of said rear face of said end plate, wherein said at least one pawl extends from a biased, tension arm formed in said end plate, and wherein when said tension arm is in a normal or non-flexed position, at least a portion of said at least one pawl extends above a portion of said rear face of said end plate; and a castle nut having an at least partially internally threaded castle nut aperture and having one or more grooves formed in a front face of said castle nut, wherein each of said one or more grooves is formed so as to accept at least a portion of said at least one pawl at least partially therein.

In certain exemplary, nonlimiting embodiments of the present disclosure, the anti-rotation end plate and castle nut include at least some of an end plate having a rear face and having at least one pawl extend above a surface of said rear face of said end plate, wherein said at least one pawl extends from a biased, tension arm formed in said end plate, and wherein when said tension arm is in a normal or non-flexed position, at least a portion of said at least one pawl extends above a portion of said rear face of said end plate; and a castle nut having an at least partially internally threaded castle nut aperture and having one or more grooves formed in a front face of said castle nut, wherein each of said one or more grooves is formed so as to accept at least a portion of said at least one pawl at least partially therein.

In certain exemplary, nonlimiting embodiments of the present disclosure, an additional hole is drilled and tapped into the end plate, which, when installed, lines up with the rear takedown detent spring aperture of the lower receiver. In this manner, the detent and spring may be inserted into the lower receiver with the end plate installed (unlike known end plates) and be retained by use of a set screw that screws into the drilled and tapped hole in the end plate.

Accordingly, the presently disclosed systems, methods, and/or apparatuses provide an end plate and castle nut that allow a user to install the castle nut without the necessity of staking the castle nut.

The presently disclosed systems, methods, and/or apparatuses optionally separately provide an end plate and castle nut that allows the castle nut to function reliably, even when hand tightened by a user.

The presently disclosed systems, methods, and/or apparatuses optionally separately provide an end plate and castle nut that may optionally be removed with the use of an armorers tool.

The presently disclosed systems, methods, and/or apparatuses optionally separately provide an end plate and castle nut that may optionally be installed and/or removed without the use of an armorers tool.

The presently disclosed systems, methods, and/or apparatuses optionally separately provide an end plate and castle nut that allows the detent and spring to be inserted into the lower receiver while the end plate is installed and be retained by use of a set screw.

The presently disclosed systems, methods, and/or apparatuses optionally separately provide an end plate and castle nut that can be easily retrofitted to an existing firearm or rifle.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
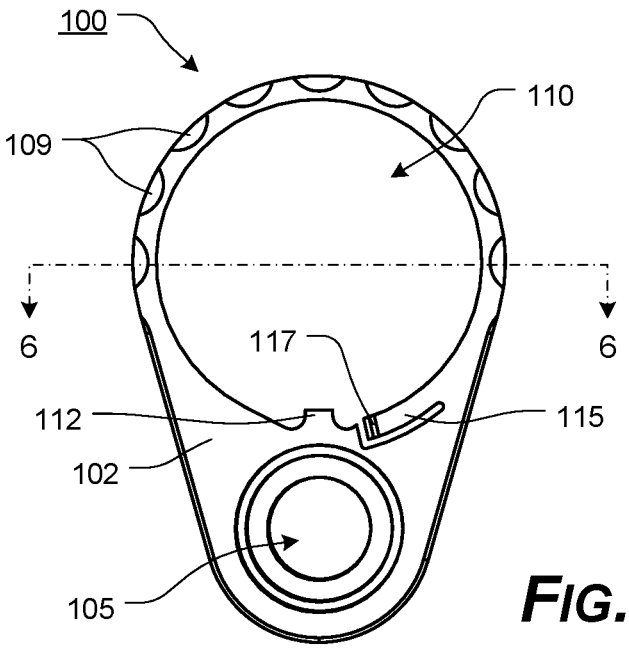
FIG. 1 illustrates a rear view of an exemplary embodiment of an end plate, according to the presently disclosed systems, methods, and/or apparatuses.
Figure 2:
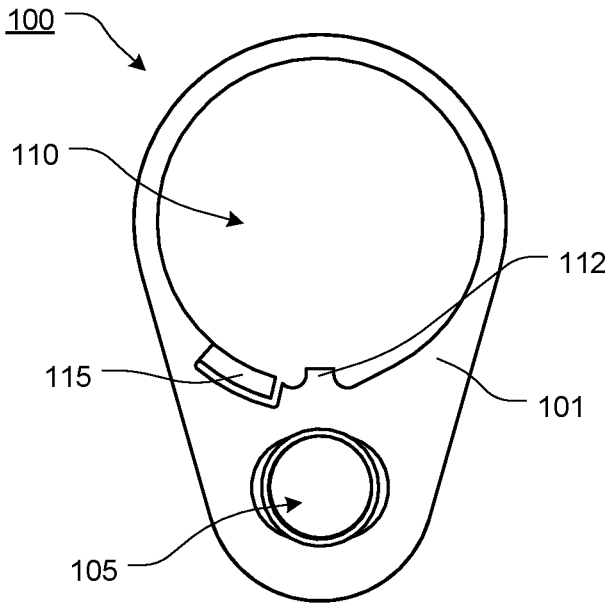
FIG. 2 illustrates a front view of an exemplary embodiment of an end plate, according to the presently disclosed systems, methods, and/or apparatuses.
Figure 3:
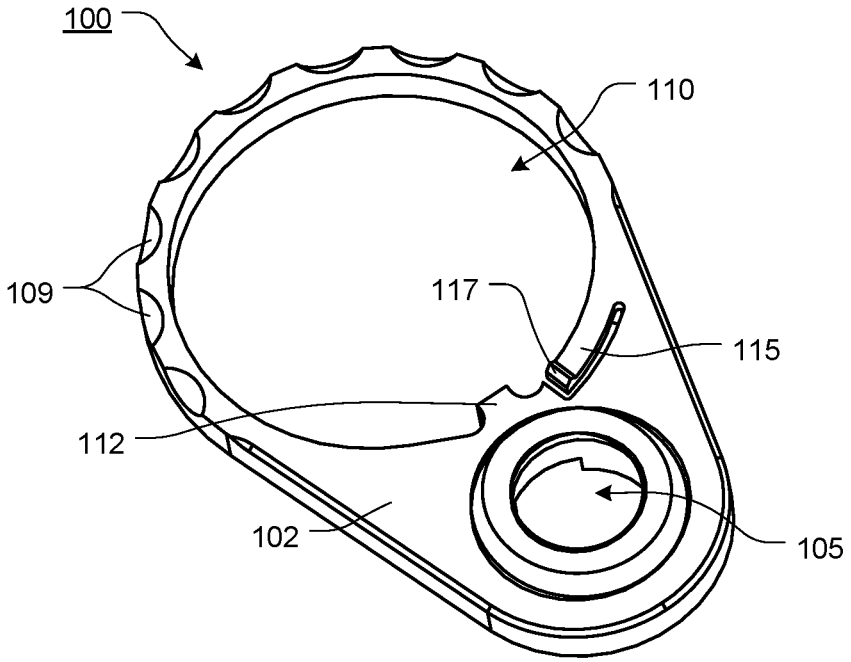
FIG. 3 illustrates a front, left, perspective view of an exemplary embodiment of an end plate, according to the presently disclosed systems, methods, and/or apparatuses.
Figure 4:
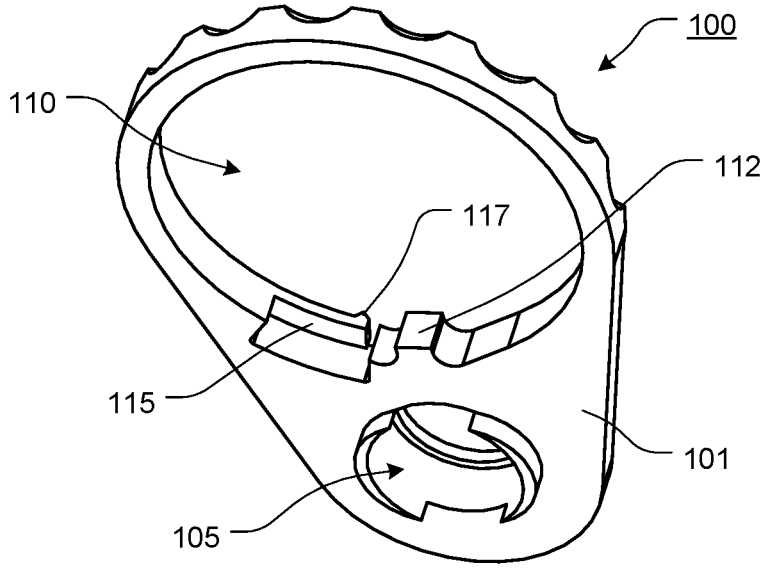
FIG. 4 illustrates an upper, perspective view of an exemplary embodiment of an end plate, according to the presently disclosed systems, methods, and/or apparatuses.
Figure 5:
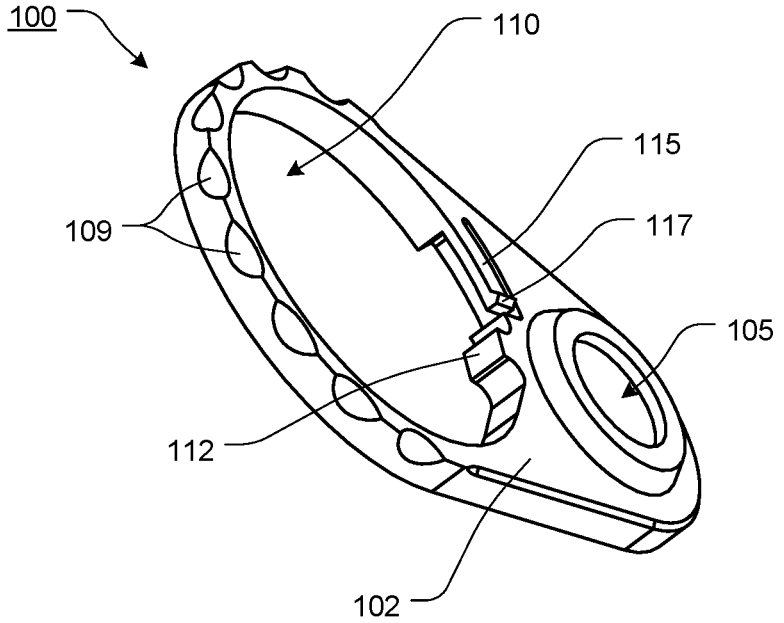
FIG. 5 illustrates an upper, left, perspective view of an exemplary embodiment of an end plate, according to the presently disclosed systems, methods, and/or apparatuses.
Figure 6:
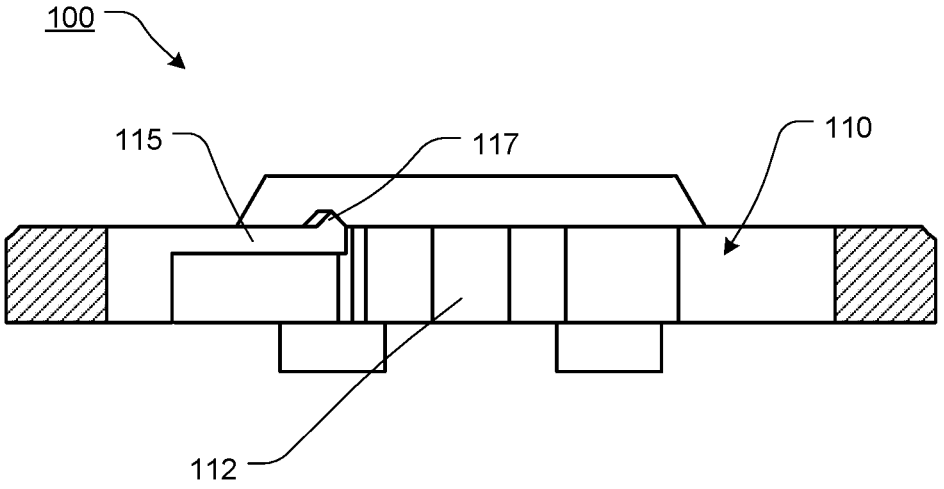
FIG. 6 illustrates a cutaway view of an exemplary embodiment of an end plate, taken along line 6-6 of FIG. 1, according to the presently disclosed systems, methods, and/or apparatuses.
Figure 7:
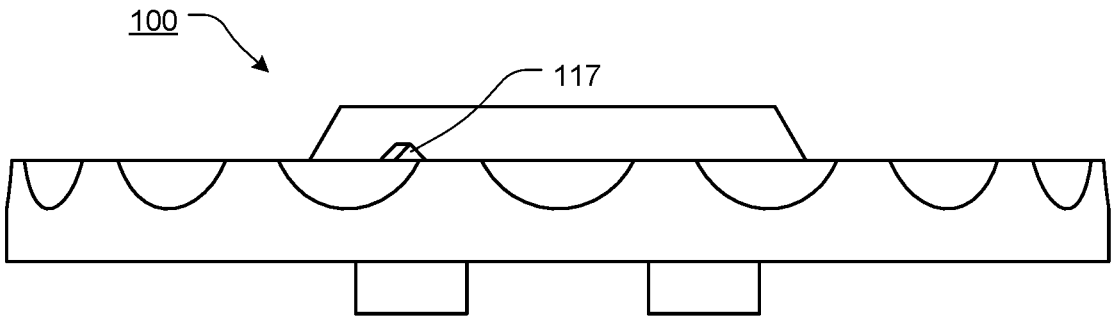
FIG. 7 illustrates a top view of an exemplary embodiment of an end plate, according to the presently disclosed systems, methods, and/or apparatuses.
Figure 8:
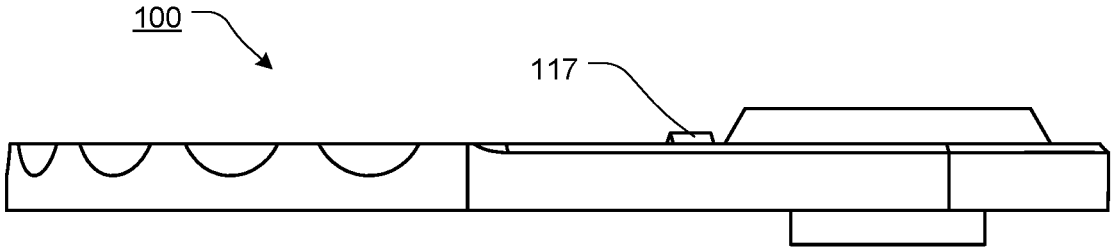
FIG. 8 illustrates a left view of an exemplary embodiment of an end plate, according to the presently disclosed systems, methods, and/or apparatuses.
Figure 9:
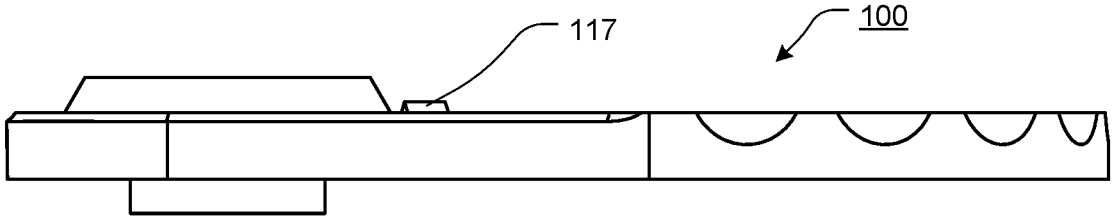
FIG. 9 illustrates a right view of an exemplary embodiment of an end plate, according to the presently disclosed systems, methods, and/or apparatuses.
Figure 10:
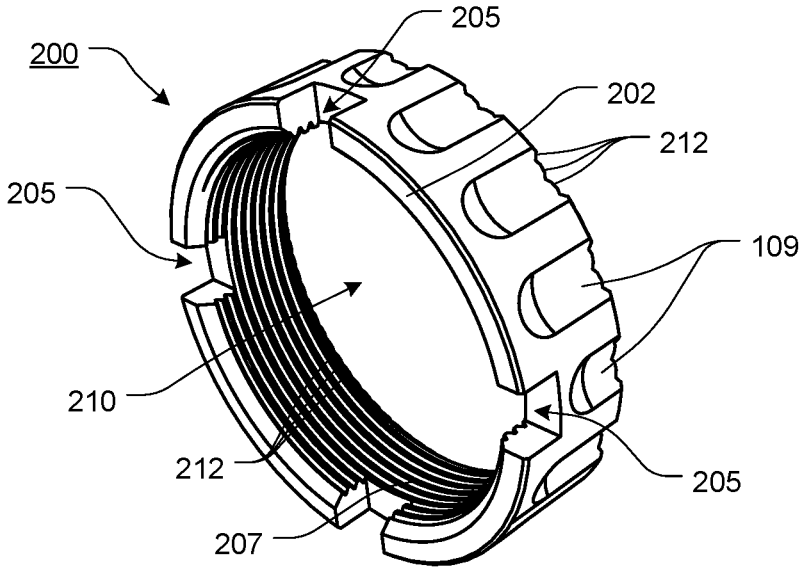
FIG. 10 illustrates a rear, right, perspective view of an exemplary embodiment of a castle nut, according to the presently disclosed systems, methods, and/or apparatuses.
Figure 11:
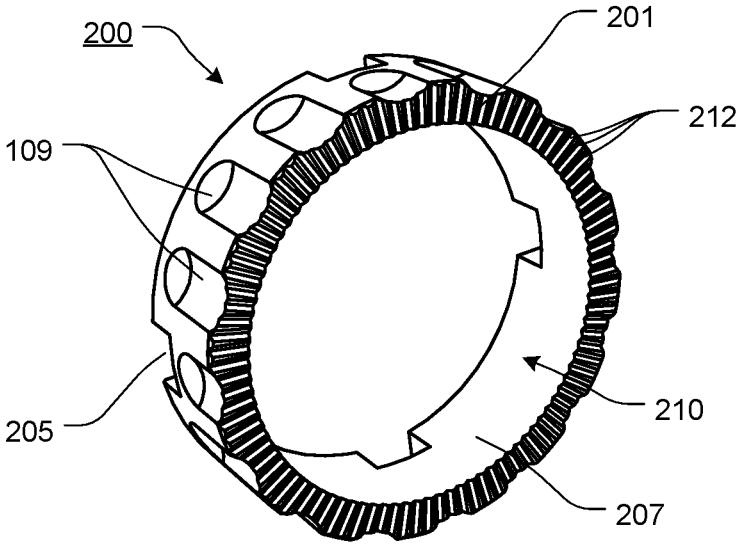
FIG. 11 illustrates a front, right, perspective view of an exemplary embodiment of a castle nut, according to the presently disclosed systems, methods, and/or apparatuses.
Figure 12:
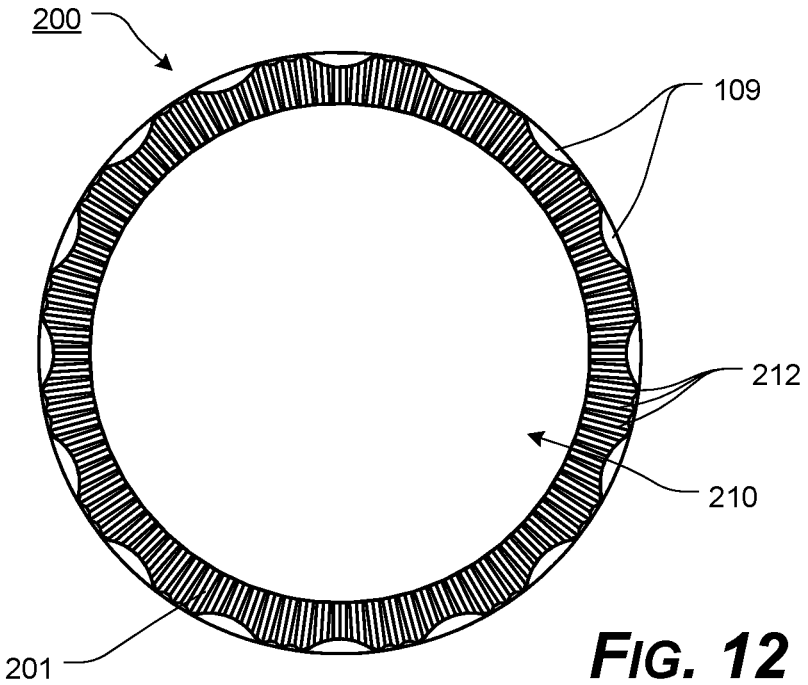
FIG. 12 illustrates a front view of an exemplary embodiment of a castle nut, according to the presently disclosed systems, methods, and/or apparatuses.
Figure 13:
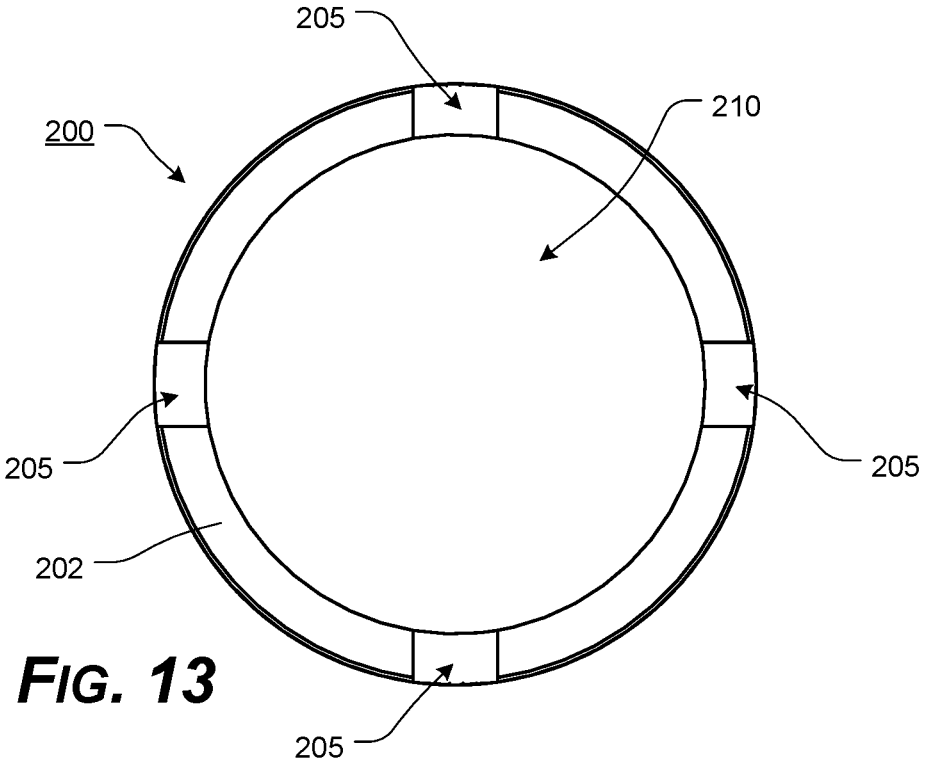
FIG. 13 illustrates a rear view of an exemplary embodiment of a castle nut, according to the presently disclosed systems, methods, and/or apparatuses.
Figure 14:
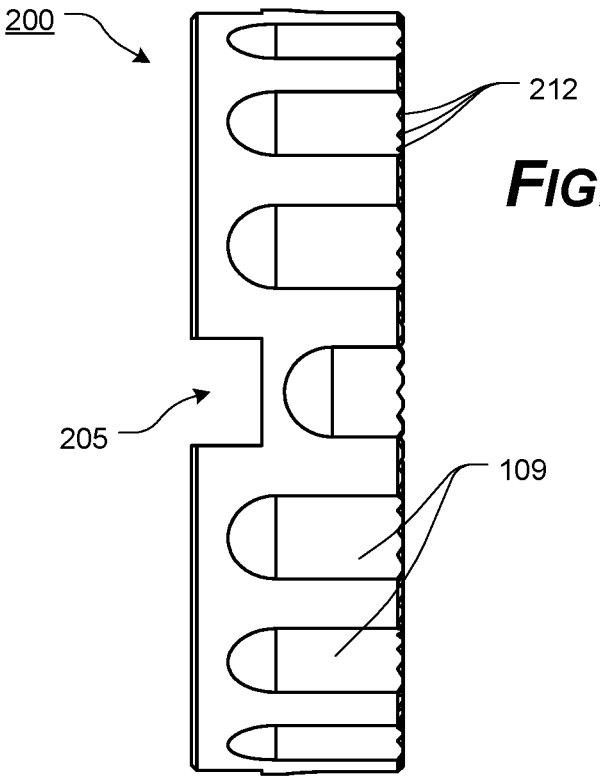
FIG. 14 illustrates a right side view of an exemplary embodiment of a castle nut, according to the presently disclosed systems, methods, and/or apparatuses.
Figure 15:
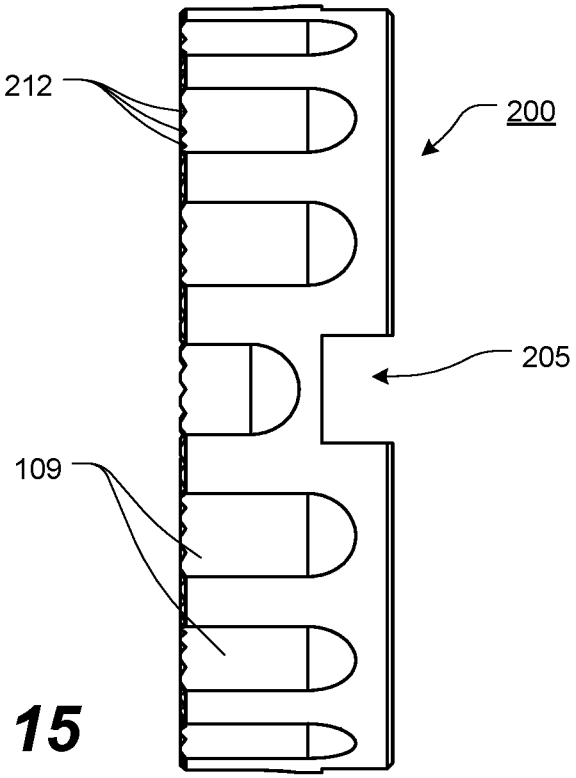
FIG. 15 illustrates a left side view of an exemplary embodiment of a castle nut, according to the presently disclosed systems, methods, and/or apparatuses.
Figure 16:
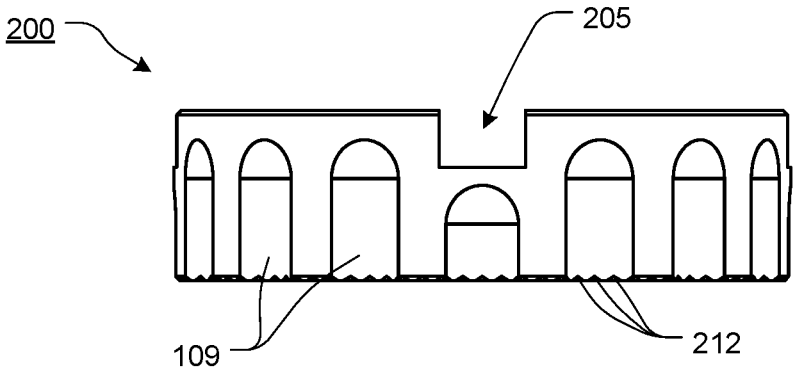
FIG. 16 illustrates a top view of an exemplary embodiment of a castle nut, according to the presently disclosed systems, methods, and/or apparatuses.
Figure 17:
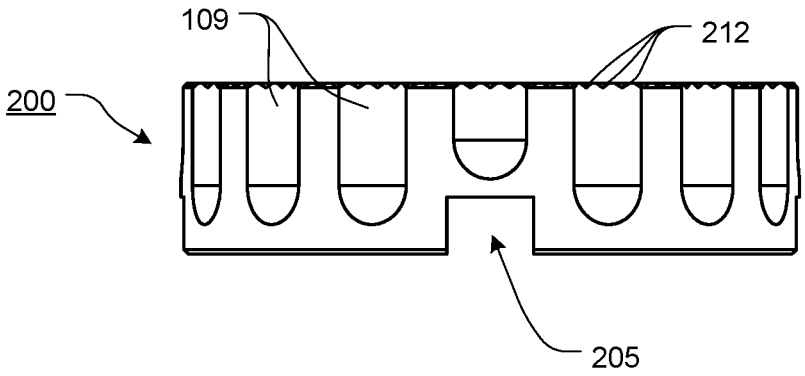
FIG. 17 illustrates a bottom view of an exemplary embodiment of a castle nut, according to the presently disclosed systems, methods, and/or apparatuses.
Figure 18:
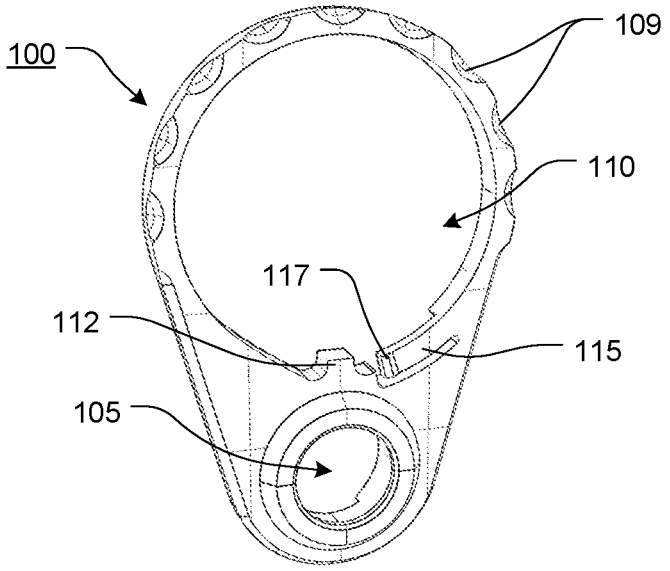
FIG. 18 illustrates a front, left, perspective view of an exemplary embodiment of an end plate, according to the presently disclosed systems, methods, and/or apparatuses.
Figure 19:
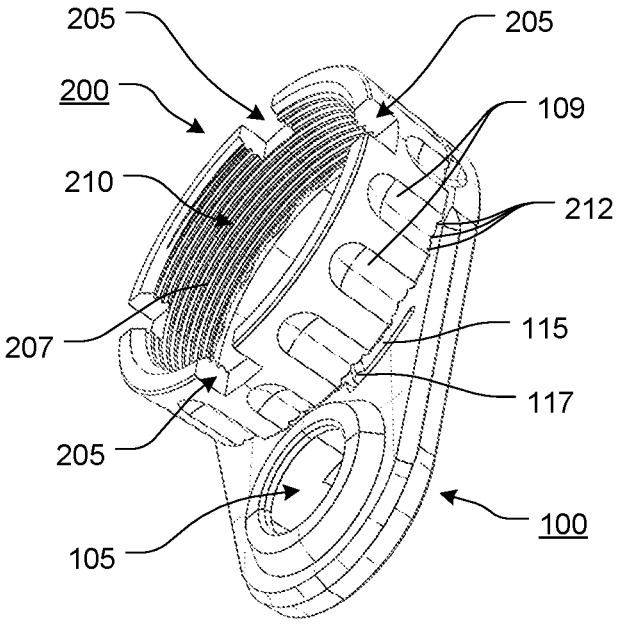
FIG. 19 illustrates a lower, right, perspective view of an exemplary embodiment of an end plate and castle nut, wherein the end plate and castle nut are aligned in an assembled or installed fashion, according to the presently disclosed systems, methods, and/or apparatuses.
Figure 20:
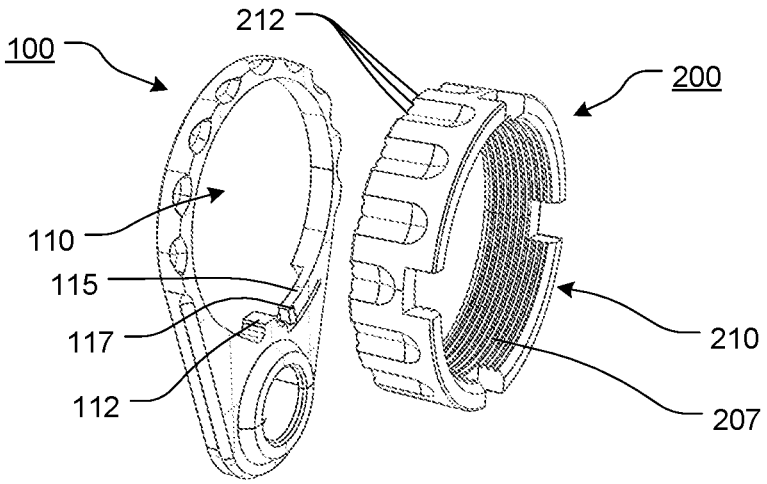
FIG. 20 illustrates a left, rear, perspective view of an exemplary embodiment of an end plate and castle nut, wherein the end plate and castle nut are aligned, according to the presently disclosed systems, methods, and/or apparatuses.
Figure 21:
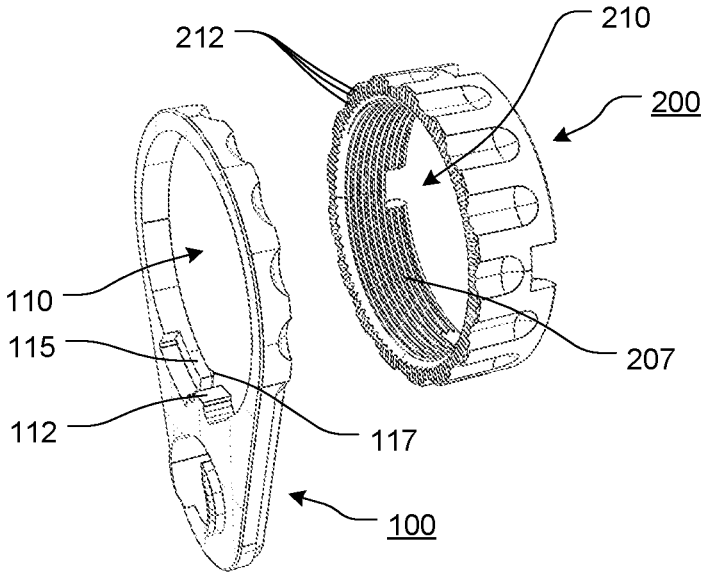
FIG. 21 illustrates an upper, left, front, perspective view of an exemplary embodiment of an end plate and castle nut, wherein the end plate and castle nut are aligned, according to the presently disclosed systems, methods, and/or apparatuses.

For simplicity and clarification, the design factors and operating principles of the end plate and castle nut according to the presently disclosed systems, methods, and/or apparatuses are explained with reference to various exemplary embodiments of an end plate and castle nut according to the presently disclosed systems, methods, and/or apparatuses. The basic explanation of the design factors and operating principles of the end plate and castle nut is applicable for the understanding, design, and operation of the end plate and castle nut of the presently disclosed systems, methods, and/or apparatuses. It should be appreciated that the end plate and castle nut can be adapted to many applications where an end plate and castle nut can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "anti-rotation", "end plate", "castle nut", and "firearm" are used for basic explanation and understanding of the operation of the presently disclosed systems, methods, and/or apparatuses. Therefore, the terms "anti-rotation", "end plate", "castle nut", and "firearm" are not to be construed as limiting the systems, methods, and/or apparatuses of the present disclosure. Thus, for example, the term "firearm" is to be understood to broadly include any firearm or other similar handheld or shoulder mounted device or tool.

For simplicity and clarification, the end plate and castle nut of the present disclosure will be described as being used in conjunction with a firearm, such as an AR-15 or M4 style rifle or carbine. However, it should be appreciated that these are merely exemplary embodiments of the end plate and castle nut and are not to be construed as limiting the presently disclosed systems, methods, and/or apparatuses. Thus, the end plate and castle nut of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., FIGS. 1-26 illustrate certain elements and/or aspects of an exemplary embodiment of the end plate 100 and castle nut 200, according to the presently disclosed systems, methods, and/or apparatuses. In illustrative, non-limiting embodiment(s) of the present disclosure, as illustrated in FIGS. 1-26, the end plate 100 comprises an end plate 100 having a buffer tube aperture 110 formed therein. A buffer tube key 112 extends into at least a portion of the buffer tube aperture 110.

The end plate 100 extends from a front face 101 to a rear face 102 and is formed so as to be attached or coupled between a buffer tube 20 and a lower receiver 10, in a similar fashion to that of a known end plate.

In various exemplary embodiments, an endplate attachment element 105 is also formed in or through at least a portion of the end plate 100. In various exemplary embodiments, the endplate attachment element 105 comprises a hole, aperture, recess, or protrusion formed so as to be at least partially engaged by an attachment device or mechanism, allowing the firearm on which the end plate 100 is installed to be attached, for example, to a sling or other device.

In certain exemplary, nonlimiting embodiments, a variety of texturing elements 109 may optionally be formed around at least a portion of the end plate 100. In various exemplary embodiments, the texturing elements 109 comprise a plurality of scalloped grooves 212 or recesses formed at spaced apart locations around at least a portion of the end plate 100. In certain alternative embodiments, the texturing elements 109, if included, may include other textured, etched, knurled, or other portions, providing increased gripping surface areas or ornamental decorations for the end plate 100.

At least one resilient, tension arm 115 is formed of a portion of the end plate 100. In various exemplary embodiments, the at least one tension arm 115 is formed as an integral portion of the material used to form the end plate 100 and is defined by a slot or groove 114 formed in at least a portion of the end plate 100. The at least one tension arm 115 is formed so as to be at least partially resiliently flexible. The thickness of the material used to form the end plate 100 may optionally be reduced along at least a portion of the tension arm 115 to render the tension arm 115 at least partially resiliently flexible. In this manner, at least a portion of the tension arm 115 is formed such that when a biasing force is applied to an end portion of the tension arm 115, at least a portion of the tension arm 115 can be flexed away from the biasing force, to or towards a biased position. When the biasing force is removed, the tensioned or flexed portion of the tension arm 115 returns to a normal or non-flexed position.

Alternatively, the tension arm 115 comprises a separate portion of material that is attached or coupled to the end plate 100.

The degree of biasing force needed to flex the portion of the tension arm 115 is a design choice, based upon the size, shape, and/or material of the tension arm 115.

In various exemplary embodiments, the tension arm 115 is formed of an area of the end plate 100, having a reduced wall thickness, as compared to other portions of the end plate 100, which causes the tension arm 115 to act as a flat spring.

At least one pawl 117 is formed so as to extend from an end portion of the tension arm 115. In various exemplary embodiments, the at least one pawl 117 comprises two side walls, which extend to an apex. In various exemplary embodiments, when the tension arm 115 is in a normal or non-flexed position, at least a portion of the sidewalls, and at least the apex of the sidewalls, extends above a surface of the rear face 102 of the end plate 100.

In various exemplary embodiments, the sidewalls extend at similar angles, such that the sidewalls of the pawl 117 are substantially symmetrical and form a substantially "U" or "V" shaped pawl 117. Alternatively, the sidewalls extend at varied angles, such that the sidewalls of the pawl 117 are asymmetrical. The degree of symmetry or asymmetry of the sidewalls of the pawl 117 is a design choice and can be varied, based upon the desired degree of rotational force necessary to rotate to the castle nut 200 relative to the end plate 100, when installed.

The castle nut 200 is a substantially circular and extends from a rear face 202 to a front face 201. The castle nut 200 includes a castle nut aperture 210 having internal threads 207 formed so as to interact with the external threads of the buffer tube 20.

In various exemplary, nonlimiting embodiments one or more castle nut engagement recesses 205 are formed in the rear face 202 of the castle nut 200, at spaced apart locations about the castle nut 200. In certain exemplary embodiments, each of the castle nut engagement recesses 205 is formed of a substantially square notch. The one or more castle nut engagement recesses 205 are formed so as to allow a wrench or other tool to be used to torque the castle nut 200 against the end plate 100.

In certain exemplary, nonlimiting embodiments, a variety of texturing elements 109 may optionally be formed around at least a portion of the castle nut 200. In various exemplary embodiments, the texturing elements 109 comprise a plurality of scalloped grooves 212 or recesses formed at spaced apart locations around at least a portion of the castle nut 200. In certain alternative embodiments, the texturing elements 109, if included, may include other textured, etched, knurled, or other portions, providing increased gripping surface areas or ornamental decorations for the castle nut 200.

A plurality of grooves 212 are formed in the front face 201 of the castle nut 200. In various exemplary embodiments, each groove 212 comprises a substantially rectangular, "U" or "V" shaped recess or groove 212 having two side walls, which extend to form a tooth or apex.

In various exemplary embodiments, the sidewalls extend at similar angles, such that the sidewalls of the each groove 212 are substantially symmetrical. Alternatively, the sidewalls extend at varied angles, such that the sidewalls of each groove 212 are asymmetrical. The degree of symmetry or asymmetry of the sidewalls of each groove 212 is a design choice and can be varied, based upon the desired degree of rotational force necessary to rotate to the castle nut 200 relative to the end plate 100 (the degree of rotational force necessary to overcome the biasing force of the pawl 117 and withdrawal the pawl 117 from an associated groove 212), when installed.

Each of the one or more grooves 212 is formed so as to accept at least a portion of the at least one pawl 117 at least partially therein and thereby interact with the at least one pawl 117.

Figure 22:
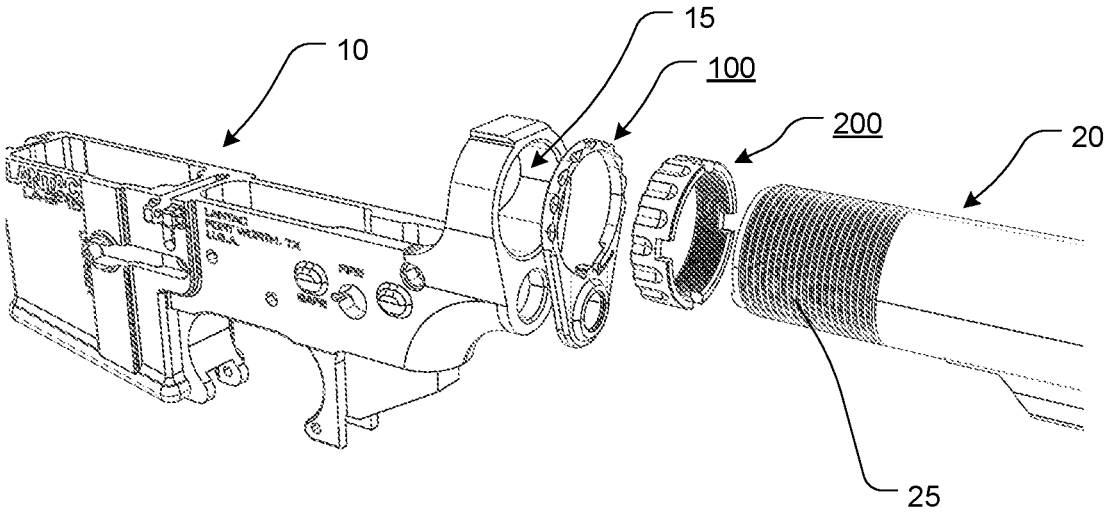
FIG. 22 illustrates a left, rear, perspective view of an exemplary embodiment of an end plate and castle nut, wherein the end plate and castle nut are aligned for assembly with a lower receiver and buffer tube, according to the presently disclosed systems, methods, and/or apparatuses.
Figure 23:
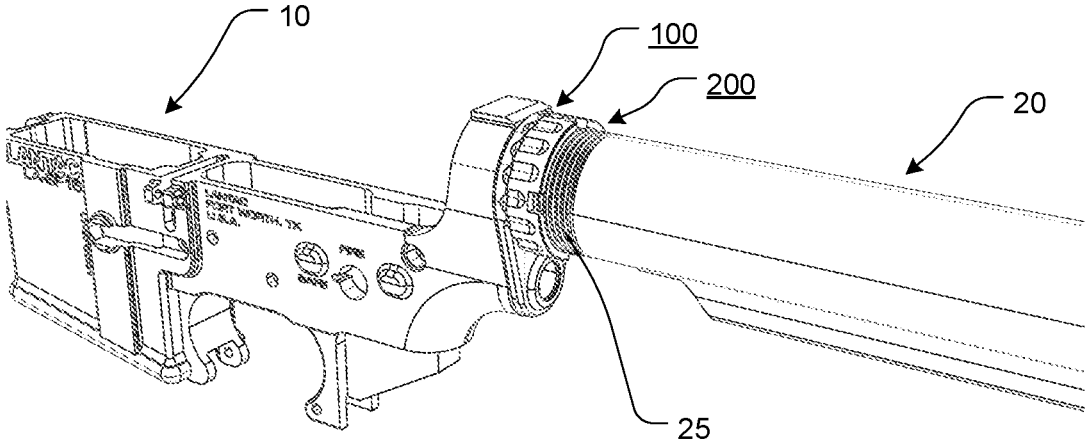
FIG. 23 illustrates a left, rear, perspective view of an exemplary embodiment of an end plate and castle nut, wherein the end plate and castle nut are assembled or installed with a lower receiver and buffer tube, according to the presently disclosed systems, methods, and/or apparatuses.
Figure 24:
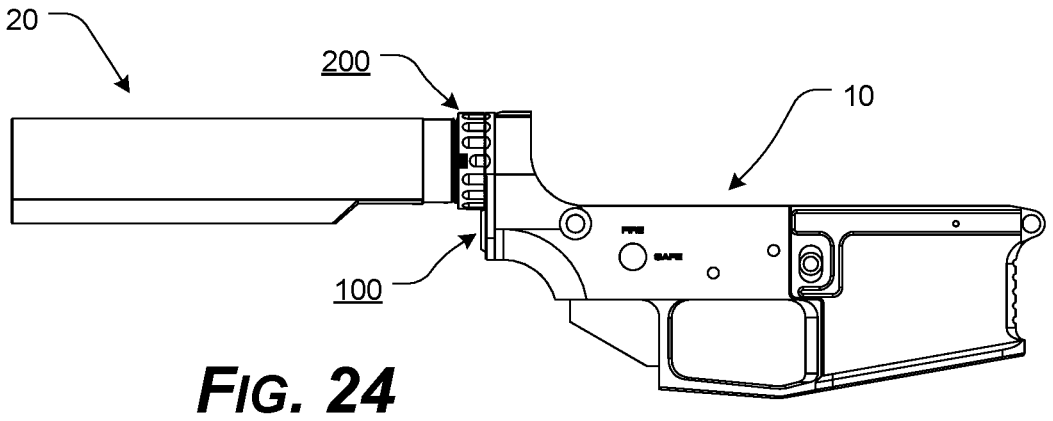
FIG. 24 illustrates a right, side view of an exemplary embodiment of an end plate and castle nut, wherein the end plate and castle nut are assembled or installed with a lower receiver and buffer tube, according to the presently disclosed systems, methods, and/or apparatuses.
Figure 25:
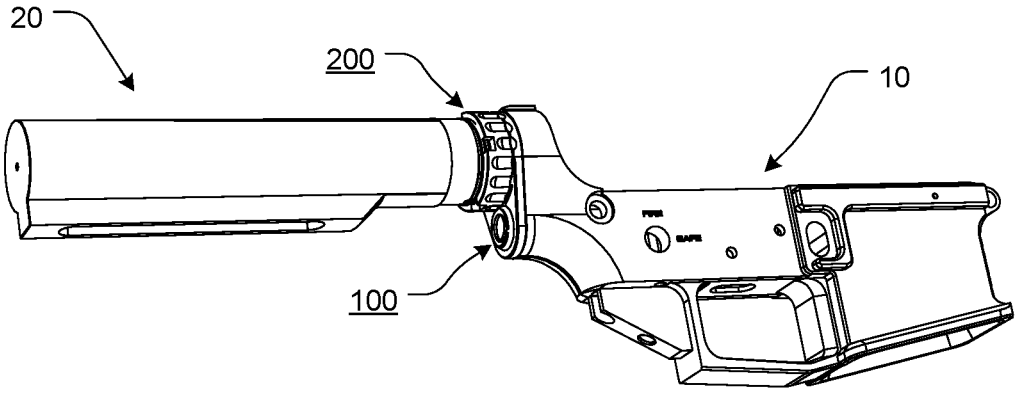
FIG. 25 illustrates a right, rear, perspective view of an exemplary embodiment of an end plate and castle nut, wherein the end plate and castle nut are assembled or installed with a lower receiver and buffer tube, according to the presently disclosed systems, methods, and/or apparatuses.

Thus, for example, as illustrated in FIGS. 22-23, while being installed, the castle nut 200 is rotationally attached to the buffer tube 20, via interaction of the internal threads 207 of the castle nut 200 in the external buffer tube threads 25 of the buffer tube 20. The end plate 100 is then aligned with the buffer tube 20, such that the buffer tube key 112 of the end plate 100 is aligned with the buffer tube key 112 groove 212 of the buffer tube 20. Once aligned, the buffer tube 20 is inserted through the buffer tube aperture 110 of the end plate 100.

The buffer tube 20 is then threaded late inserted within the buffer tube receiving aperture 15, via interaction of the external buffer tube threads 25 and the internal buffer tube receiving aperture 15 threads. The buffer tube 20 is rotated until it is appropriately threadedly attached to the lower receiver 10.

The castle nut 200 is then rotated so as to travel toward the front end of the buffer tube 20, such that the front surface of the castle nut 200 is urged toward the rear surface of the end plate 100, urging the front surface of the end plate 100 against the lower receiver 10.

As the castle nut 200 is tightened on the buffer tube 20, the pawl 117 engages the front surface of the castle nut 200 and the grooves 212. As the castle nut 200 continues to be tightened, along the buffer tube 20, the contact between the front surface of the castle nut 200 and the pawl 117 urges the biased, tension arm 115 to a further biased position and increases the frictional engagement force between the pawl 117 and subsequent grooves 212, as the castle nut 200 is rotated.

When the castle nut 200 is appropriately torqued, at least a portion of the pawl 117 will rest within at least one groove 212. The interaction between the pawl 117 of the end plate 100 and the groove 212 of the castle nut 200, acts to catch the castle nut 200 and stop the castle nut 200 from being able to counter-rotate or loosen through normal use.

Using the end plate 100 and castle nut 200 of the present disclosure, the castle nut 200 does not need to be staked. In addition, it is possible to hand tighten the castle nut 200 and the castle nut 200 still function reliably as the castle nut 200 cannot come loose. Using the end plate 100 and castle nut 200 of the present disclosure, a user is able to remove the castle nut 200 with the use of an armorer's tool.

Figure 26:
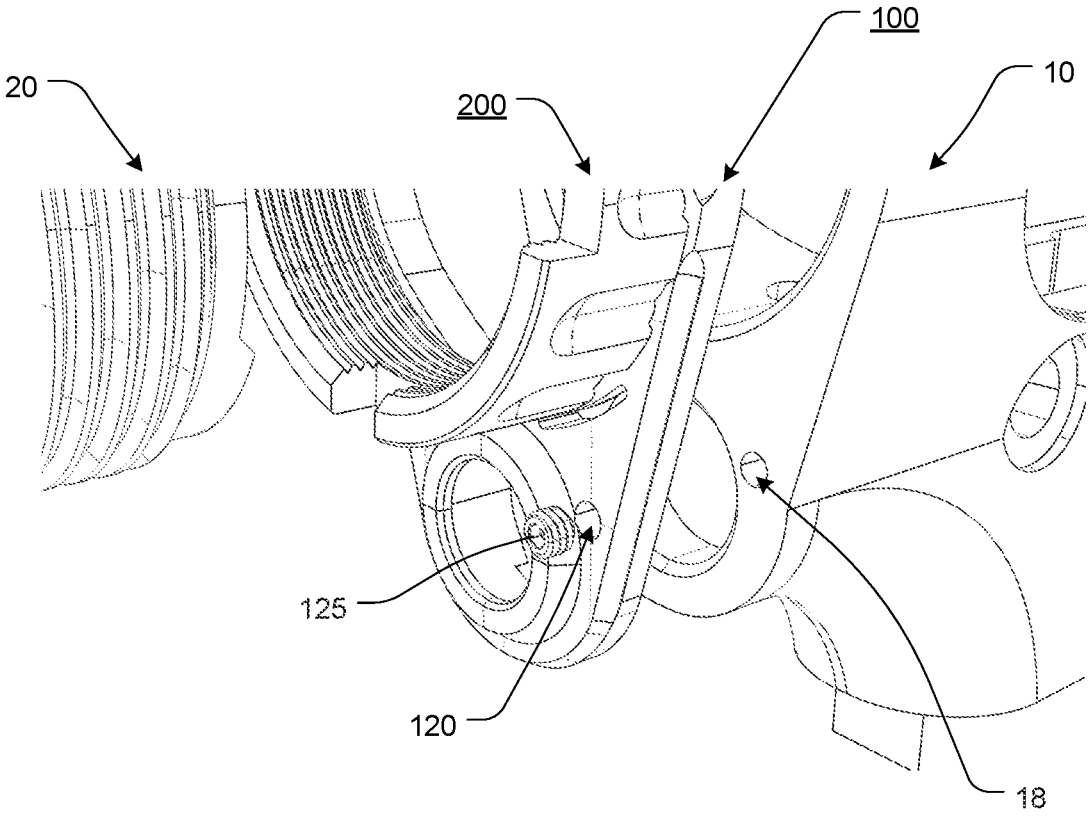
FIG. 26 illustrates a right, rear, perspective view of an exemplary embodiment of an end plate and castle nut, wherein the end plate and castle nut are aligned for installation with a lower receiver and buffer tube, according to the presently disclosed systems, methods, and/or apparatuses.

In certain exemplary, nonlimiting embodiments of the present disclosure, as illustrated in FIG. 26, an additional aperture, a set screw aperture 120, is drilled and tapped into the end plate 100, which, when installed, aligns with the rear takedown detent spring aperture 18 of the lower receiver 10. In this manner, the detent and spring may be inserted into the lower receiver 10 with the end plate 100 installed (unlike known end plates) and be retained by use of a set screw 125 that screws into the drilled and tapped hole in the end plate 100. Thus, when the end plate 100 is installed, the set screw aperture 120 aligns with the rear takedown detent spring aperture 18 of the lower receiver 10, such that the detent and spring may be inserted into the lower receiver 10 and retained by the set screw 125 at least partially threadedly inserted into the set screw aperture 120.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An anti-rotation end plate and castle nut for a firearm, comprising:

an end plate having at least one pawl, wherein said at least one pawl extends from a biased, tension arm formed in said end plate; and a castle nut extending from a rear face to a front face and having one or more grooves formed in said front face of said castle nut, wherein each of said one or more grooves is formed so as to accept at least a portion of said at least one pawl at least partially therein.

2. The end plate and castle nut of claim 1, wherein said tension arm is formed of an area of said end plate, having a reduced wall thickness as compared to a wall thickness of an area of said end plate adjacent said tension arm.

3. The end plate and castle nut of claim 1, wherein said tension arm is formed as an integral portion of said material used to form said end plate and is defined by a slot formed in at least a portion of said end plate.

4. The end plate and castle nut of claim 1, wherein said tension arm and said at least one pawl are formed integral to said end plate.

5. The end plate and castle nut of claim 1, wherein a buffer tube key extends into at least a portion of said buffer tube aperture.

6. The end plate and castle nut of claim 1, wherein an aperture forms an endplate attachment element in at least a portion of said end plate.

7. The end plate and castle nut of claim 1, wherein one or more texturing elements are formed around at least a portion of said end plate.

8. The end plate and castle nut of claim 1, wherein said at least one pawl comprises two side walls, which extend to an apex.

9. The end plate and castle nut of claim 1, wherein when said tension arm is in a non-flexed position, at least a portion of said at least one pawl extends above a rear face of said end plate.

10. The end plate and castle nut of claim 1, wherein said castle nut includes an at least partially internally threaded castle nut aperture, wherein said at least partially internally threaded castle nut aperture is formed so as to interact with external threads of a buffer tube.

11. The end plate and castle nut of claim 1, wherein one or more texturing elements are formed around at least a portion of said castle nut.

12. The end plate and castle nut of claim 1, wherein each of said one or more grooves extend radially and said front face of said castle nut.

13. The end plate and castle nut of claim 1, wherein each of said one or more grooves comprises a substantially "V" shaped groove.

14. The end plate and castle nut of claim 1, wherein an at least partially internally threaded set screw aperture is formed in the end plate, such that, when the end plate is installed, said set screw aperture aligns with a rear takedown detent spring aperture of a lower receiver, such that a detent and spring may be inserted into the lower receiver and retained by a set screw at least partially threadedly inserted into the set screw aperture.

15. An anti-rotation end plate and castle nut for a firearm, comprising:

an end plate extending from a front face to a rear face and having at least one pawl extend above a surface of said rear face of said end plate, wherein said at least one pawl extends from a biased, tension arm formed in said end plate, and wherein when said tension arm is in a non-flexed position, at least a portion of said at least one pawl extends above a portion of said rear face of said end plate; and a castle nut having an at least partially internally threaded castle nut aperture and having one or more grooves formed in a front face of said castle nut, wherein each of said one or more grooves is formed so as to accept at least a portion of said at least one pawl at least partially therein.

16. The end plate and castle nut of claim 15, wherein said tension arm is formed of an area of said end plate, having a reduced wall thickness as compared to a wall thickness of an area of said end plate adjacent said tension arm and is defined by a slot or groove formed in at least a portion of said end plate.

17. The end plate and castle nut of claim 15, wherein said at least one pawl comprises two side walls, which extend to an apex.

18. The end plate and castle nut of claim 15, wherein a set screw aperture is formed in the end plate, such that, when the end plate is installed, said set screw aperture aligns with a rear takedown detent spring aperture of a lower receiver, such that a detent and spring may be inserted into the lower receiver and retained by a set screw at least partially inserted into the set screw aperture.

19. An anti-rotation end plate and castle nut for a firearm, comprising:

an end plate having a rear face and having at least one pawl extend above a surface of said rear face of said end plate, wherein said at least one pawl extends from a biased, tension arm formed in said end plate, and wherein when said tension arm is in a non-flexed position, at least a portion of said at least one pawl extends above a portion of said rear face of said end plate; and a castle nut having an at least partially internally threaded castle nut aperture and having one or more grooves formed in a front face of said castle nut, wherein each of said one or more grooves is formed so as to accept at least a portion of said at least one pawl at least partially therein.

20. The end plate and castle nut of claim 19, wherein a set screw aperture is formed in the end plate, which is allignable with a rear takedown detent spring aperture of a lower receiver.

* * * * *